US006244273B1

(12) United States Patent
Higgins

(10) Patent No.: US 6,244,273 B1
(45) Date of Patent: Jun. 12, 2001

(54) WATER COMB

(75) Inventor: Lieutenant Higgins, 1260 Latham St., Memphis, TN (US) 38126

(73) Assignee: Lieutenant Higgins, Memphis, TN (US)

( * ) Notice: Subject to any disclaimer, the term of this patent is extended or adjusted under 35 U.S.C. 154(b) by 0 days.

(21) Appl. No.: 09/461,866

(22) Filed: Dec. 15, 1999

(51) Int. Cl.[7] ..... A45D 24/22; A61G 17/02; A61H 7/00

(52) U.S. Cl. ..... 132/114; 132/112; 433/80; 601/165

(58) Field of Search ..... 132/114, 112, 132/113, 115; 433/80; 601/162, 165, 163, 164

(56) References Cited

U.S. PATENT DOCUMENTS 3,593,707 * 7/1971 Pifer ..... 128/62
3,754,557 * 8/1973 Moore ..... 132/114
3,854,489 * 12/1974 Doyle et al. ..... 132/114
4,376,441 * 3/1983 Duncan ..... 132/114
5,095,893 * 3/1992 Rawden ..... 128/66
5,220,914 * 6/1993 Thompson ..... 128/66
5,381,964 * 1/1995 Reyna ..... 239/566
5,746,595 * 5/1998 Ford ..... 433/80
5,870,782 * 2/1999 Kanneberg ..... 6/606
5,934,902 * 8/1999 Abahusayn ..... 433/80
6,089,865 * 7/2000 Edgar ..... 433/89

* cited by examiner

*Primary Examiner*—John J. Wilson
*Assistant Examiner*—Robyn Kieu Doan
(74) *Attorney, Agent, or Firm*—John D. Gugliotta; Michael J. Corrigan

(57) ABSTRACT

This invention is a comb that is attachable to a faucet to allow water to run through the comb's hollow-shaped inner body. The water travels through the faucet, plastic or rubbertubing, the comb's inner body, and exits through the comb's hollow-shaped teeth with an exit portal at the tip. The comb's two assemblies are a shower adapter, essentially tubing for the shower arm and connector on the comb, and the water holes, allowing water to flow through the comb. The shower adapter also has a bi-directional valve on it to direct water either to the comb or the shower head.

6 Claims, 3 Drawing Sheets

WATER COMB

RELATED APPLICATIONS

The present invention was first described in Disclosure Document Number 448153 filed on Dec. 4, 1998. There are no previously filed, nor currently any co-pending applications, anywhere in the world.

BACKGROUND OF THE INVENTION

1. Field of the Invention

The present invention relates generally to hair care products and, more particularly, to a comb with internal conduits for delivering water and dispensing hair care products from the tips of the comb.

2. Description of the Related Art

Personal hair styles are as unique as one's personality. In the world of hair styling, there are literally thousands of styles from which to choose. While the styles are many, most stylists and beauticians agree that proper grooming and maintenance of one's hair is just as important as styling hair. As a result, most people undergo a regimen of washing and rinsing their hair, applying conditioners and treatments that maintain not only the hair but the scalp as well. After properly shampooing, rinsing and conditioning the hair, it is dried and combed in order to maintain it in a tangle-free condition, ready for styling. While this process is necessary in maintaining one's hair style, it also can become a burden. Accordingly, there is a constant need for new and innovative products that will serve to aid and enhance the process of maintaining ones hair. The development of the Water Comb fulfills this need.

The Water Comb is a device that serves to combine several of the steps required in the hair grooming process. Consisting of an otherwise conventional comb structure, the device includes a system of internal water delivery conduits that dispense water from the tips of the comb teeth. The water is delivered to the comb via a hose that includes a variety of interchangeable attachment devices for connecting to a shower head or bathtub spigot. Arranged in-line with the hose is a reservoir that meters in shampoo or conditioner as the water passes therethrough. During use, the user simply passes the comb through their hair as they would normally do when using a conventional comb or brush. The comb applies the shampoo/conditioner while massaging the scalp and combing the hair, washing, rinsing and grooming the hair and thus performing the required tasks simultaneously in a quick and convenient fashion. As a result, use of the Water Comb allows one to follow proper hair care practices, free of the burdens associated with traditional methods.

In the related art, there exists many patents for similar hollow core to comb/product dispensers with internal conduits that deliver hair care products such as dyes, perfume, water, treatment solutions and the like to the hair. These products generally have a reservoir for holding the dispensed product or are connected to a conventional container holding the product. However, none of these patents disclose connecting a water source via a flexible hose to the comb in addition to being able to dispense a hair care product. U.S. Pat. No. 3,754,557, issued on Aug. 28, 1973 to Moore discloses a hollow comb having conduits for delivering fluids to the scalp. The comb has a threaded aperture for receiving the threaded necks of fluid containers such as shampoo bottles and the like, or, selectively, the threaded coupling end of a flexible hose. The present invention is distinct from this invention in that the Moore invention is not designed to deliver both a hair care product and water to the scalp simultaneously. The present invention is specifically designed to receive a water source and dispense a hair care product to the scalp at the same time.

A search of the prior art did not disclose any patents that read directly on the claims of the instant invention; however, the following references were considered related:

| U.S. Pat. No. | Inventor | Issue Date |
|---|---|---|
| 5,803,093 | Romano | September 8, 1998 |
| 5,483,979 | Bertieri | Jan. 16, 1996 |
| 3,754,557 | Moore | August 28, 1973 |
| 5,365,880 | South | November 22, 1994 |
| 5,289,835 | Harlan et al. | March 1, 1994 |
| 5,725,130 | Kluge et al. | March 10,1998 |
| 5,339,839 | Forcelledo et al. | Aug. 23, 1994 |
| 5,311,887 | Ramsey | May 17, 1994 |
| 5,056,480 | Murray, Sr. | Oct. 15, 1991 |
| 3,147,757 | Hofmann | Not Available |
| 1,667,631 | Mach | April 28, 1928 |
| 841,175 | Phinney | Not Available |

SUMMARY OF THE INVENTION

It is therefore an object of the present invention to provide an improved hair grooming device with the combined functionality of a hair care product dispenser and water applicator.

It is a feature of the present invention to provide water conduits to deliver water to the scalp.

It is another feature of the present invention to store and automatically meter shampoo and conditioner.

It is yet another feature of the present invention to provide universal/interchangeable connections to allow connection to the shower head, faucet, or spigot.

It is still yet another feature of the present invention to enable one to wash and rinse hair.

It is yet still another feature of the present invention to enable one to comb hair.

It is another feature of the present invention to enable one to massage the scalp.

Briefly described according to one embodiment of the present invention, a Water Comb is provided comprised of an otherwise conventional comb structure, a system of internal water delivery conduits for dispensing from the tips of the comb teeth, a flexible hose with a variety of interchangeable attachment devices for connecting to a shower head or bathtub spigot, a valve located in the handle for controlling water flow, and an internal reservoir for receiving and dispensing conventional hair care products. One simply connects the device to a suitable water source such as the shower head, fills with the desired hair care product, and opens the valve on the handle to allow water and the hair care product to be dispensed from the tips of the comb.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

| | | | |
|---|---|---|---|
| 10 | Water Comb | 50a | Threaded Inlet Connector |
| 20 | Hollow Comb | 50b | Threaded Outlet Connector |
| 20a | Threaded Connector | 50c | Reservoir Cap |
| 20b | Main Body Conduit | 50d | Threaded Nipple |
| 20c | Teeth | 50e | Interior Volume |
| 20d | Teeth Conduits | 50f | Metering Means |
| 20e | Orifice | 50g | Conduit |
| 20f | Sponge Handgrip | 60 | Water Supply Hose |
| 30 | Faucet Switch | 60a | Threaded Connector |
| 40 | Reservoir Connection Hose | | |
| 50 | Dispenser Reservoir | | |

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
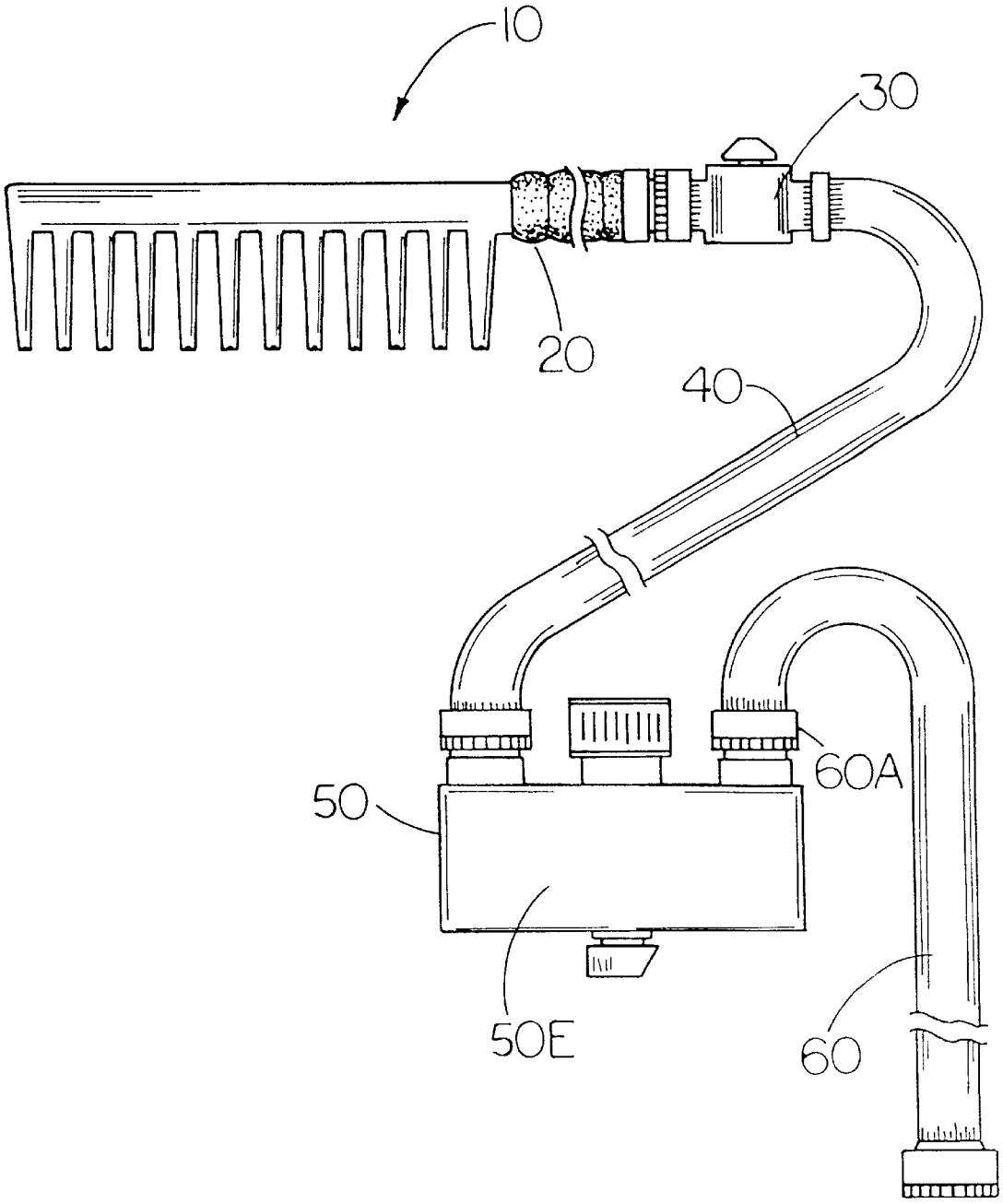
FIG. 1 is a perspective view of a Water Comb, according to the preferred embodiment of the present invention.

Referring now to FIG. 1, shown is perspective view of a Water Comb 10 comprised of hollow comb 20, faucet switch 30, reservoir connection hose 40, dispenser reservoir 50, and faucet connection hose 60. Referring in combination with FIG. 2, comb 20 is comprised of main body and conduit 20*b*, teeth 20*c* extending therefrom with conduits 20*d* running therethrough and in fluid communication with main body and conduit 20*b*. It is envisioned that comb 20 is manufactured from plastic using well known injection molding techniques.

At one end of comb 20 is threaded connector 20*a* in fluid communication with main body and conduit 20*b*. Threaded connector 20*a* is threaded male for receiving the female threads of threaded connector attached to one end of faucet switch 30. The other end of faucet switch 30 is permanently connected to reservoir connection hose 40 and in permanent fluid communication therewith. Faucet switch 30 is of a simple push button design to allow one to control the flow of fluid from reservoir connection hose 40 to the main body and conduit 20*b* of comb 20. The other end of reservoir connection hose 40 has a female threaded connector 40 for receiving the male threads of threaded outlet connector 50*b* of reservoir 50 for placing reservoir connection hose 40 in fluid communication with reservoir 50. Another male threaded connector, threaded inlet connector 50*a*, is located on the opposite side of reservoir 50 for receiving the female threads of threaded connector 60*a* of water supply hose 60 thereby placing faucet supply hose 60 in fluid communication with reservoir 50. The other end of reservoir connection hose 60 has a female threaded connector for receiving the male threads of a connector attached to the shower head or a diverter valve connected to the shower arm for receiving water under pressure from same or any other conventional water source. It is envisioned that reservoir connection hose 40 and water supply hose 60 are manufactured from flexible plastic or rubber.

Reservoir 50 is of generally made of plastic and formed with conventional injection molding techniques. Reservoir 50 has an internal volume 50*c* for receiving conventional hair care products as heretofore discussed. Reservoir 50 also has a means whereby the contents of volume 50*c* are gradually metered into the water flowing into reservoir 50 from water supply hose 60. For purposes of this disclosure it is not important exactly how this is done as there are many well known techniques and devices whereby a product may be metered into a fluid stream. The mixed contents of water and hair care product are then forced out of reservoir 50 into reservoir connection hose 40 and ultimately into main body and conduit 20*b* of comb 20 for application on the user's scalp and hair.

An orifice formed in the top of reservoir 50 with associated threaded nipple and cap 50*c* allows one to fill reservoir 50 with a hair care product of choice.

Figure 2:
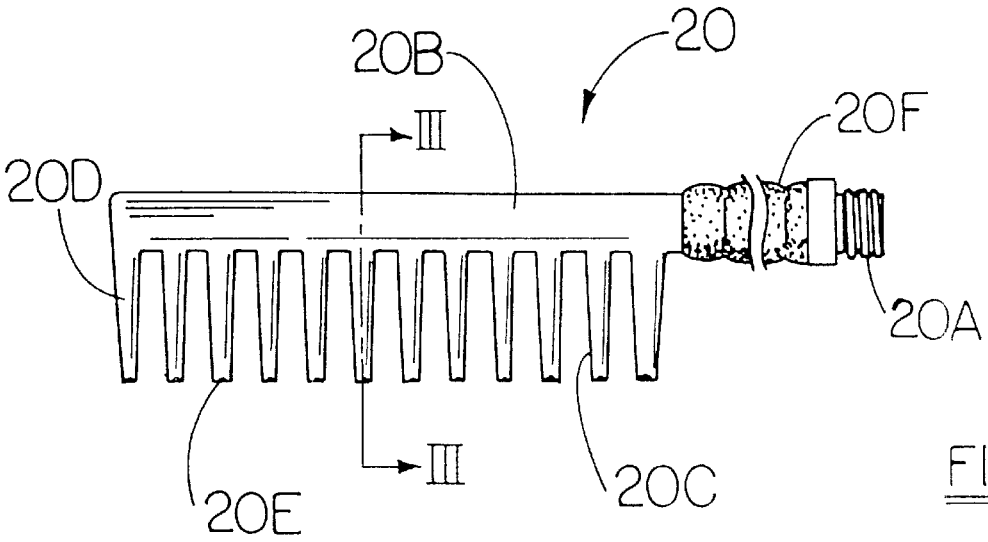
FIG. 2 is a side view of the comb of a Water Comb, according to the preferred embodiment of the present invention.

Referring now to FIG. 2, shown is a side view of comb 20 showing the detail of teeth 20*c* extending from the main body and conduit 20*b* of comb 20. A sponge handgrip 20*f* lines the portion of main body and conduit 20*b* adjacent to said threaded connector 20*a*. Comb 20 is generally eight inches in length along its elongated longitudinal axis. Comb 20 measures approximately two and one-half inches from the scalp end of teeth 20*c* to the center of the conduit of main body and conduit 20*b*. Teeth 20*c* are general cylindrical in shape being hollow in the center forming conduits 20*d*, approximately quarter of an inch in outer diameter, and tapered to a somewhat narrower orifice 20*e* located on the scalp end. It is envisioned that orifice 20*e* would be approximately nine one-hundredths of an inch in diameter. It is envisioned that comb 20 would have approximately twelve or more teeth 20 spaced evenly along and in fluid communication with main body and conduit 20*b*. The foregoing dimensions and specifications are only given as a suggestion and in no way imply a limitation on the final specifications of water comb 10. The final specifications will depend on the specific application and the user's desire.

Figure 3:
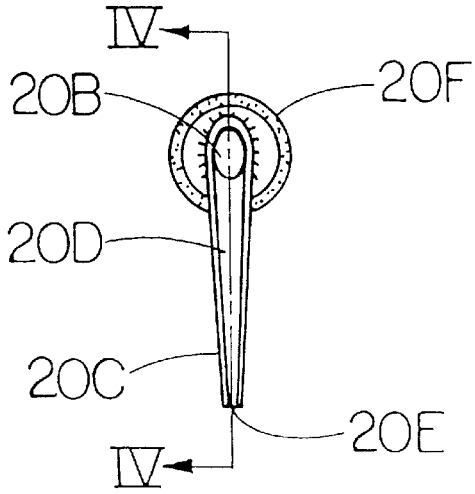
FIG. 3 is a cross sectional view of a comb of a Water Comb taken along line III—III of FIG. 2, according to the preferred embodiment of the present invention.
Figure 4:
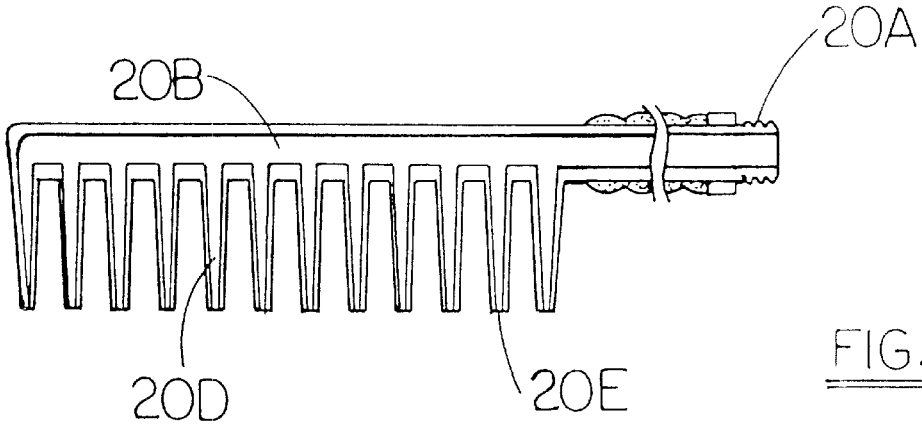
FIG. 4 is a longitudinal cross sectional view of a comb of a Water Comb taken along line IV—IV of FIG. 3, according to the preferred embodiment of the present invention.

Referring now to FIG. 3, shown is a cross sectional view of comb 20 taken along III—III of FIG. 2 showing the detail of teeth conduits 20*d* extending from main body and conduit 20*b* to orifice 20*e*. Fluid received via reservoir connection hose 40 connected at threaded connection 20*a* flows through main body and conduit 20*b* into teeth conduits 20*d* through orifice 20*e* onto the scalp and hair. This can be seen in even greater detail in FIG. 4 where a longitudinal cross sectional view of comb 20 is taken along line IV—IV of FIG. 3.

Figure 5:
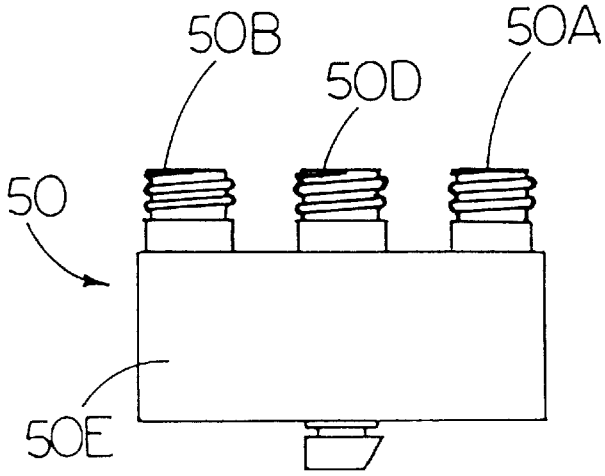
FIG. 5 is a side view of a hair care product reservoir of a Water Comb, according to the preferred embodiment of the present invention.
Figure 6:
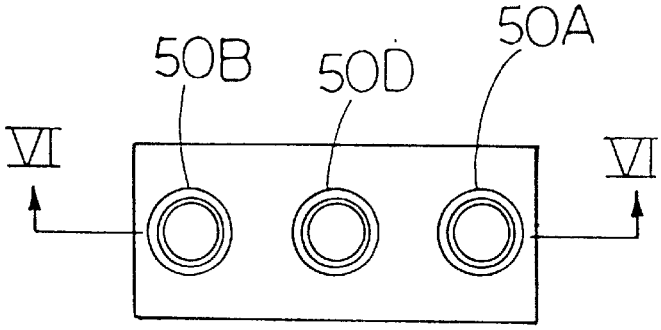
FIG. 6 is a top view of a hair care product reservoir of a Water Comb, according to the preferred embodiment of the present invention.

Referring now to FIGS. 5 and 6, a side and top view of reservoir 50 is shown. Note the positions of threaded inlet connector 50*a*, threaded outlet connector 50*b* and threaded nipple 50*c*. Threaded nipple 50*c* places interior volume 50*e* in fluid communication with the atmosphere. To fill interior volume 50*e*, one simply unscrews cap 50*c* (not shown) from threaded nipple 50*d* and pours their favorite hair care product into interior volume 50*e*.

Figure 7:
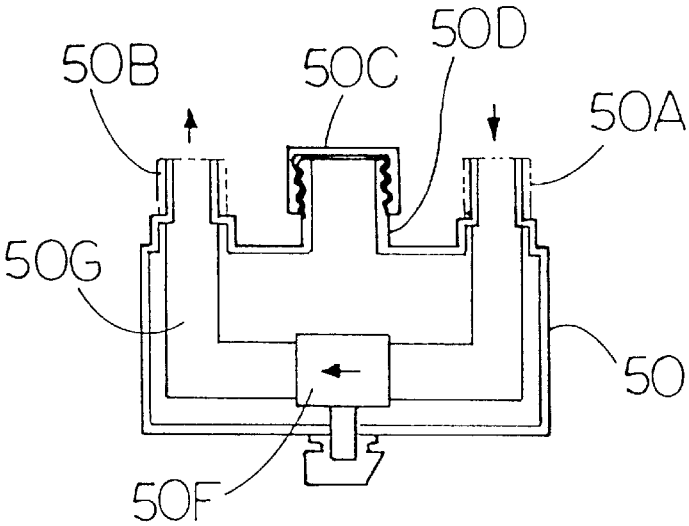
FIG. 7 is a cross sectional view of a hair care product reservoir taken along line V—V of FIG. 6, according to the preferred embodiment of the present invention.

Referring now to FIG. 7, a cross sectional view of reservoir 50 taken along lines VI—VI of FIG. 6 is shown showing the detail of the interior of reservoir 50. Shown is metering means 50*f* in fluid communication with conduit 50*g* between threaded connector 50*a* and threaded connector 50*b*. Metering means 50*f* is also in fluid communication with interior volume 50*e*. Metering means 50*f* is designed to draw the contents of interior volume 50*e*, typically a select hair care product, and controllably inject it into conduit 50*g*. Water under pressure received from water supply hose 60 through threaded connector 50*a* carries the injected product to water comb 10 through reservoir connection hose 40.

2. Operation of the Preferred Embodiment

To use the present invention, one simply connects the supplied water supply hose to either the shower head with a special adapter, the shower arm fitted with a diverter valve, or some other water source. A favorite hair care product is put into a specially designed reservoir which release the hair care product into the water. A special hollow body comb receives the water/hair care product and delivers it to the hair ans scalp through a set of hollow teeth. A simple push button valve is fitted on the hose connecting the water comb to the fluid reservoir to allow one to turn the device on and off. One simply needs to push the button and run the comb through his/her scalp and the water and hair care product are released.

The foregoing description is included to illustrate the operation of the preferred embodiment and is not meant to limit the scope of the invention. The scope of the invention is to be limited only by the following claims.

What is claimed is:

1. A comb comprising:

a comb element having a main body, a conduit, and teeth extending therefrom with conduits running therethrough and in fluid communication with main body and conduit;

a reservoir connection hose in fluid communication with said conduit of said comb element;

a faucet switch design to allow one to control the flow of fluid from said reservoir connection hose to the main body and conduit of the comb;

a dispenser reservoir in fluid communication with said conduit through said faucet switch, and faucet connection hose.

2. The comb of claim 1, wherein at one end of said comb element is a threaded connector in fluid communication with main body and conduit, said threaded connector being threaded male for receiving the female threads of threaded connector attached to one end of said faucet switch, and at the other end of said reservoir connection hose has a female threaded connector for receiving the male threads of threaded outlet connector of reservoir for placing reservoir connection hose in fluid communication with reservoir.

3. The comb of claim 2, further comprising a threaded inlet connector located on the opposite side of reservoir for receiving the female threads of threaded connector of water supply hose thereby placing faucet supply hose in fluid communication with reservoir.

4. The comb of claim 3, wherein said reservoir has an internal volume for receiving conventional hair care products, said reservoir further including means whereby the contents of volume are gradually metered into the water flowing into reservoir from water supply hose.

5. The comb of claim 1, further comprising a sponge handgrip lining the portion of main body and conduit adjacent to said threaded connector.

6. The comb of claim 1, wherein said teeth are general cylindrical in shape being hollow in the center forming conduits approximately quarter of an inch in outer diameter, and tapered to a somewhat narrower orifice located on the scalp end.

* * * * *